US007995778B2

(12) United States Patent
Berardi et al.

(10) Patent No.: US 7,995,778 B2
(45) Date of Patent: Aug. 9, 2011

(54) ACOUSTIC TRANSDUCER ARRAY SIGNAL PROCESSING

(75) Inventors: William Berardi, Grafton, MA (US); Eric J. Freeman, Sutton, MA (US); Michael W. Stark, Acton, MA (US)

(73) Assignee: Bose Corporation, Framingham, MA (US)

( * ) Notice: Subject to any disclaimer, the term of this patent is extended or adjusted under 35 U.S.C. 154(b) by 1405 days.

(21) Appl. No.: 11/462,496

(22) Filed: Aug. 4, 2006

(65) Prior Publication Data

US 2008/0031474 A1 Feb. 7, 2008

(51) Int. Cl.
*H04R 5/02* (2006.01)

(52) U.S. Cl. ..... 381/310; 381/97; 381/98; 181/125

(58) Field of Classification Search ..... 381/97, 381/98, 1, 17, 300, 302, 304, 310, 104, 89, 381/18, 59; 181/125

See application file for complete search history.

(56) References Cited

U.S. PATENT DOCUMENTS

| | | | | |
|---|---|---|---|---|
| 4,569,074 | A | 2/1986 | Polk | |
| 4,819,269 | A | 4/1989 | Klayman | |
| 4,847,904 | A | 7/1989 | McShane | |
| 4,888,804 | A | 12/1989 | Gefvert | |
| 4,994,687 | A | 2/1991 | Oyaba et al. | |
| 5,027,403 | A | 6/1991 | Short et al. | |
| 5,121,433 | A * | 6/1992 | Kendall et al. | 381/1 |
| 5,333,200 | A | 7/1994 | Cooper et al. | |
| 5,870,484 | A | 2/1999 | Greenberger | |
| 6,263,083 | B1 * | 7/2001 | Weinreich | 381/97 |
| 7,561,706 | B2 * | 7/2009 | Holmi et al. | 381/306 |
| 2003/0002693 | A1 | 1/2003 | Aylward et al. | |
| 2004/0105550 | A1 * | 6/2004 | Aylward et al. | 381/17 |
| 2004/0105559 | A1 * | 6/2004 | Aylward et al. | 381/103 |
| 2004/0196982 | A1 | 10/2004 | Aylward et al. | |
| 2005/0063555 | A1 | 3/2005 | Berardi et al. | |
| 2005/0221867 | A1 * | 10/2005 | Zurek et al. | 455/569.1 |
| 2006/0083382 | A1 * | 4/2006 | Sako et al. | 381/17 |
| 2009/0238383 | A1 * | 9/2009 | Meyer et al. | 381/182 |
| 2009/0304213 | A1 * | 12/2009 | Cook et al. | 381/300 |

FOREIGN PATENT DOCUMENTS

| | | |
|---|---|---|
| EP | 1 670 282 | 6/2006 |
| WO | WO 99/08479 | 2/1999 |
| WO | WO 2005/086526 | 9/2005 |

OTHER PUBLICATIONS

International Preliminary Report on Patentability dated Feb. 19, 2009 for PCT/US07/074618.

CN OA dated Nov. 11, 2010 for CN Appln. No. 200780001038.9.

* cited by examiner

*Primary Examiner* — Vivian Chin
*Assistant Examiner* — Friedrich Fahnert

(57) ABSTRACT

A set of filters is configured to distribute input signals representing a single perceptual axis to first and second physically separate arrays of loudspeakers comprising at least first and second transducers, such that the arrays of loudspeakers will create an array pattern corresponding to the input signals when the input signals are between a first frequency and a second frequency.

44 Claims, 12 Drawing Sheets

ACOUSTIC TRANSDUCER ARRAY SIGNAL PROCESSING

BACKGROUND

This description relates to acoustic transducer array signal processing.

Acoustic transducers (sometimes called drivers) of loudspeaker systems may be grouped in arrays (for example, acoustic dipoles or pairs of acoustic monopoles) to increase the power of, or to directionally control the magnitude and phase of, the radiation from the transducers. Arrays may take the form of acoustic dipoles or pairs of acoustic monopoles, for example.

As shown in FIG. 7, an acoustic dipole 702 (for example, an open-backed speaker that radiates sound equally from the front and rear faces of its diaphragm) effectively radiates energy in two lobes 704*a* and 706*a* centered along an axis 707 at θ=±90 on graph 700, with the waves from the front and back canceling out along the mid-plane 708 of the dipole 702 at θ=0. The region of cancellation, referred to as a null, can be used to create psychoacoustic effects, such as altering the direction from which a sound is perceived to originate. As shown in FIGS. 7B and 7C, the lobes may be asymmetric (704*b*, 706*b* in FIG. 7B; 704*c*, 706*c* in FIG. 7C), and there may be nulls on only one plane (e.g., along null axis 710 in FIG. 7B) or on more than one plane (e.g., along null axes 712, 714 in FIG. 7C). FIG. 7B also illustrates that there may be variation between an ideal radiation pattern 716 and an actual radiation pattern 718 generated by real transducers (not shown).

SUMMARY

In general, in one aspect, filters operate on an input signal to provide output signals and cross-feed signals to transducers of first and second arrays so that a plurality of transducers of the first array produce destructive interference in a first frequency range; the transducers of the first array do not produce destructive interference in a second frequency range; and a first transducer of the first array and a first transducer of the second array produce destructive interference in the second frequency range.

Implementations may include one or more of the following features.

The first frequency range includes a range of frequencies for which the corresponding wavelengths are greater than twice a spacing between the transducers in the first array. The range of frequencies is also one for which the corresponding wavelengths are less than twice a spacing between the first and second array. The second frequency range includes a range of frequencies for which the corresponding wavelengths are greater than twice a spacing between the first and second array. The first frequency range includes frequencies between about 1 kHz and about 3 kHz. The second frequency range includes frequencies below about 1 kHz.

The first frequency range includes frequencies between an upper frequency and a lower frequency and the filters includes; in series, an inverting low-pass filter having a corner frequency at the upper frequency and a high-pass filter having a corner frequency at the lower frequency, providing output signals to the first transducer of the first array; and an all-pass filter phase-matched to the high-pass filter and providing output signals to the second transducer of the first array. The filters are configured to delay the output signal to the first transducer of the first array relative to the output signal to the second transducer of the first array. The filters attenuate the cross-feed signals to the transducers of the second array when the input signal is in the first frequency range. The first frequency range includes frequencies between an upper frequency and a lower frequency and the filters include; a low-pass filter having a corner frequency at the lower frequency and providing cross-feed signals to the second array; and an all-pass filter phase-matched to the low-pass filter and providing output signals to the first array.

The second frequency range includes frequencies below a first upper frequency and the filter include: an inverting low-pass filter having a corner frequency at the upper frequency and providing cross-feed signals to the second array; and an all-pass filter phase-matched to the inverting low-pass filter and providing output signals to the first array. The filters attenuate the output signals to a second transducer of the first array when the input signal is in the second frequency range. The second frequency range includes frequencies below a first upper frequency and the filters include: a first high-pass filter having a corner frequency at the first upper frequency and providing output signals to the second transducer of the fist array; a first all-pass filter phase-matched to the high-pass filter and providing output signals to the first transducer of the first array; and a second all-pass filter phase-matched to the first all-pass filter and providing cross-feed signals to the first transducer of the second array. The filters also include: a second high-pass filter having a corner frequency at the first upper frequency, providing cross-feed signals to a second transducer of the second array, and phase matched to the second all-pass filter. The filters provide output signals and cross-feed signals to the second transducer of the first and second array in a third frequency range including frequencies below a second upper frequency that is lower than the first upper frequency. The filters include: first and second low-pass filters having corner frequencies at the second upper frequency and providing output signals and cross-feed signals to the second transducer of each of the first and second arrays, respectively; and first and second all-pass filters phase matched to the first and second low-pass filters, respectively, and to each other, and providing output signals and cross-feed signals to the first transducer of each of the first and second arrays, respectively.

The filters also provide the output signals and cross-feed signals to the transducers of the first and second arrays so that no destructive interference is produced in a third frequency range. The third frequency range includes a range of frequencies for which the corresponding wavelengths are less than twice a spacing between the transducers in the first array. The third frequency range includes frequencies above about 3 kHz. The third frequency range includes frequencies above a lower frequency, and the filters are configured to cause the first transducer of the first array to be to be active, and to attenuate the output signals to the second transducer of the first array when an input signal is above the lower frequency. The filters include a low-pass filter having a corner frequency at the lower frequency and providing output signals to the second transducer of the first array. The filters are also configured to attenuate the cross-feed signals to the transducers of the second array when the input signal is in the third frequency range. The filters include: a first low-pass filter having a corner frequency at the lower frequency and providing output signals to the second transducer of the first array; a second low-pass filter having a corner frequency at or lower than the lower frequency and providing cross-feed signals to the second array; and an all-pass filter phase-matched to the second low-pass filter and providing output signals to the first array.

The filters include a first all-pass filter providing output signals to a first summing input of the first array, a second all-pass filter providing output signals to an input to the first transducer of the first array, a first low-pass filter and a first high-pass filter in series and providing output signals to a first summing input to the second transducer of the first array, a second low-pass filter providing output signals to a second summing input to the second transducer of the first array, a third low-pass filter providing cross-feed signals to a first summing input of the second array, a third all-pass filter providing cross-feed signals to an input to the first transducer of the second array, a fourth low-pass filter and a second high-pass filter in series and providing cross-feed signals to a first summing input to the second transducer of the second array, and a fifth low-pass filter providing cross-feed signals to a second summing input to the second transducer of the second array. The second and fifth low-pass filter have corner frequencies at a lower frequency; the third low-pass filter and the first and second high-pass filters have corner frequencies at an intermediate frequency; and the first and fourth low-pass filters have corner frequencies at an upper frequency. The filters also include a sixth low-pass filter providing a cross-feed signal to a second summing input of the first array; a fourth all-pass filter providing an output signal to a second summing input of the second array; and in which a first signal input is coupled to the first all-pass filter and the third low-pass filter, and a second signal input is coupled to the fourth all-pass filter and the sixth low-pass filter.

The filters also provide the output signals and cross-feed signals to the transducers of the first and second arrays so that the transducers of the first array do not produce destructive interference in a an additional frequency range; and a plurality of transducers of the first array and a plurality of transducers of the second array produce destructive interference in the additional frequency range. The additional frequency range includes frequencies below about 550 Hz.

The filters also operate on a second input to provide output signals and cross-feed signals to the transducers of the second and first arrays so that a plurality of transducers of the second array produce destructive interference in the first frequency range; the transducers of the second array do not produce destructive interference in the second frequency range; and the first transducer of the first array and the first transducer of the second array produce destructive interference based on both the first input signal and the second input signal in the second frequency range. The first input signal is a left-side signal and the second input signal is a right-side signal.

In general, in one aspect, filters operate on an input signal to provide output signals and cross-feed signals to drive transducers of first and second arrays so that transducers of the first array produce substantially different degrees of destructive interference in respectively first and second frequency ranges; and a transducer of the first array and a transducer of the second array produce destructive interference in the second frequency range; in which first signals driving the first array and second signals driving the second array are not identical.

Advantages include enhancing low-frequency output efficiency of a loudspeaker system that includes speaker arrays, where each array works independently to create nulls in acoustic radiation at high frequencies, and the arrays work together to create nulls at lower frequencies. The combination of closely-spaced transducers within each array and greater spacing between the arrays allows efficient radiation of power for both high frequency and low frequency signals. The perceptual axis can be positioned beyond the physical range of the arrays.

Other features and advantages will be apparent from the description and the claims.

DESCRIPTION

Figure 1:
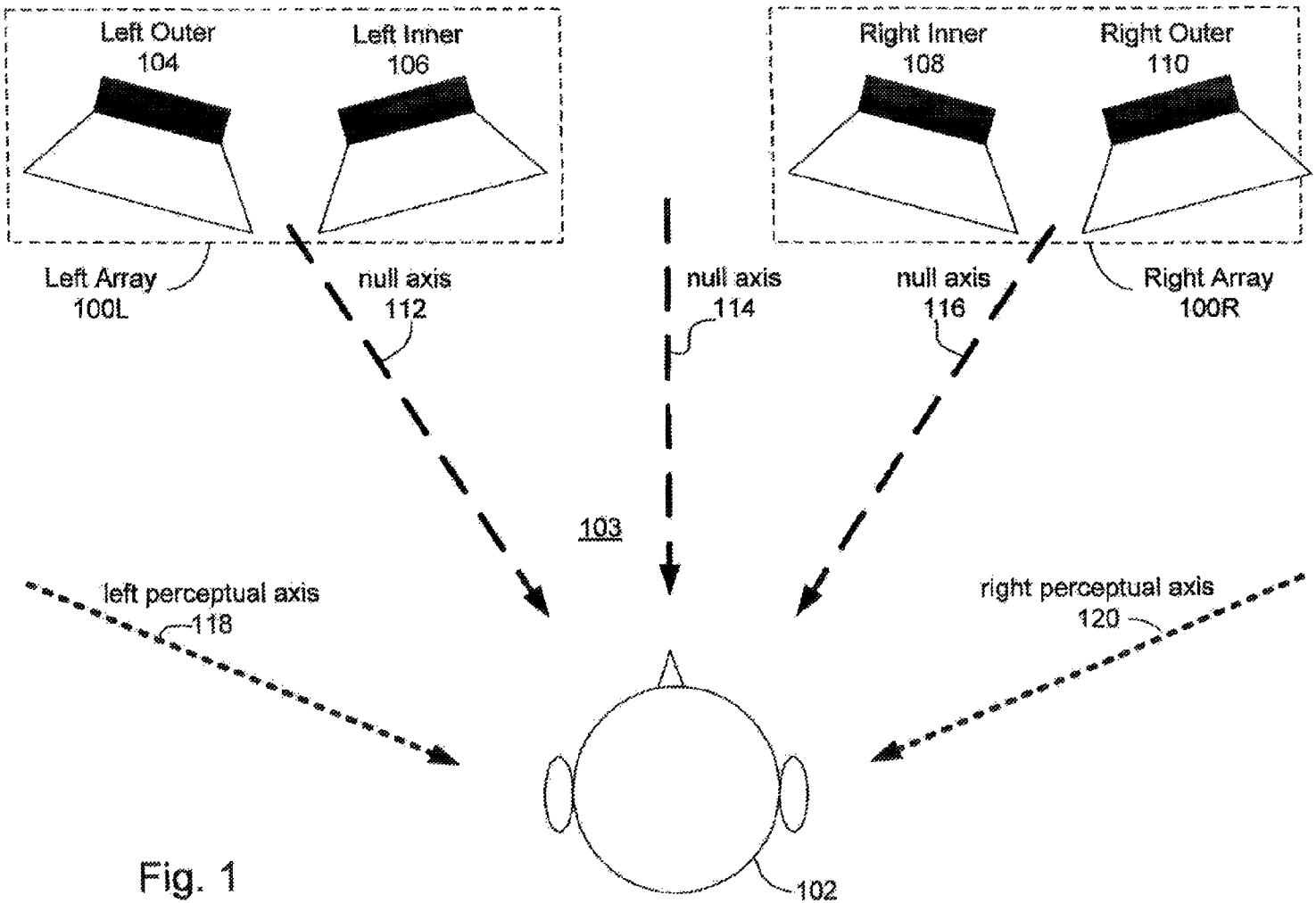
FIG. 1 is a schematic view of an audio system.

By combining acoustic sources to form arrays and processing acoustic signals that are delivered to the sources and to the arrays, the radiation patterns of a loudspeaker system that includes the arrays can be controlled to achieve a variety of goals for the acoustic energy that is radiated by the loudspeaker system to a listener, including generating various types of radiation patterns which can be more complex than the radiation patterns of the individual sources. The acoustic signal processing can include delaying, inverting, filtering, phase-shifting, or level-shifting the signals applied to each transducer relative to the signals applied to other transducers. At given points in space in the vicinity of the system, the acoustic output from the transducers may, for example, interfere constructively (increasing sound pressure) or destructively (decreasing sound pressure). Nulls can be created to take desired shapes and steered to a desired angles. For simplicity of understanding, we will view directivity in a descriptively useful plane, such as a horizontal plane. In the horizontal plane, we may discuss steering a "null axis" to a desired angle. However it should be understood that in three-dimensional space the null may have a three dimensional shape, such as a conical shell, where the angle of the shell walls are varied. For the case of a dipole-type source, the cone angle is 180 degrees, and the shape of the null deteriorates to a simple plane. For a cardioid shape, the cone angle is zero degrees, and the null shape deteriorates to a simple line.

Some aspects of driving acoustic transducers are discussed in co-pending application titled "Reducing Resonant Motion in Undriven Loudspeaker Drivers," filed Aug. 4, 2006, and incorporated here by reference.

Because the effects of the signal processing on the radiated acoustic energy are dependent on the frequencies of the signals (and therefore of the acoustic waves) and on the relative positions of the transducers, various combinations of signal processing and groupings of transducers may be used to create desired acoustic effects in various ranges of frequencies.

The signal processing may be performed using either analog or digital signal processing techniques. Analog signal processing systems typically use analog filters formed using op amps and various passive components arranged to accomplish desired filtering functions. Digital signal processing can be accomplished in various types of digital systems, such as a general-purpose computer, controlled by software of firmware, or a dedicated device such as a digital signal processing (DSP) processor. Discrete components and analog and digital systems may be used in combination. These signal processing components and systems may be centrally located or distributed (or a combination of the two) among the speaker arrays, individual transducers, or other system components, such as receivers, amplifiers, and equalizers.

Trade-offs among efficiency, frequency range, and control of directivity are required when using a destructive interference. In some examples, a predetermined radiation pattern with a null along a null axis oriented at a desired angle can be achieved up to a frequency for which the spacing between two transducers is one-half the wavelength of the acoustic output. Above such a frequency, multiple lobes and nulls begin to appear, which may conflict with an intended effect. The efficiency of a system (the amount of acoustic energy, or power, that can be delivered to the listening environment, for a fixed amount of power input) directly depends on the spacing between the speakers. Larger spacing gives higher efficiency but (as explained) reduces the maximum frequency at which directivity can be controlled. In some examples, an array may have small spacing between its own transducers to maintain control at high frequencies, and large spacing between transducers from different arrays, to provide sufficient output power at low frequencies.

In some examples, as shown in FIG. 1, an audio system includes two speaker arrays, a left array 100L and a right array 100R, meant to be located on corresponding sides of a listening environment 103 and to reproduce corresponding left and right signals of, for example, a stereo source. Signals intended for one side or the other can be manipulated and cross-fed to the opposite side in order to achieve a radiation pattern that can, for example, direct a null toward the listener (or in another desired direction) while enhancing the system's efficiency.

Each array 100L, 100R includes two transducers, which we refer to as left outer transducer 104, left inner transducer 106, right inner transducer 108, and right outer transducer 110. The transducers may or may not be identical. In one frequency range, for example, a higher frequency range (frequencies with a wavelength less than twice the separation between individual transducers within each array), each array works independently and only one transducer is used in each array, so no nulls are produced. At moderate frequencies (for example, frequencies with a wavelength less than twice the separation between the separate arrays), each array again works independently to reproduce its corresponding left and right signals and to steer those signals using the combination of that array's transducers to produce nulls. At lower frequencies, the arrays work together using one or both transducers in each.

For a left channel signal, the left array 100L steers a null in a desired direction, shown by null axis 112, by using its two transducers 104, 106 with appropriate signal processing to achieve a predetermined radiation pattern. An example of appropriate signal processing feeds a left channel signal to the outside transducer 104 and an identical but out-of-phase left channel signal to the inside transducer 106. (This assumes the two transducers 104 and 106 are identical. If they are not, the two signals may not be identical.) The desired null axis direction can be controlled by introducing delay between the two identical but out-of-phase left channel signals, or by filtering the signal fed to one transducer differently than the signal fed to the other transducer. If desired, the efficiency of array 100L can be increased by attenuating the signal applied to the transducer 106 relative to that applied to the transducer 104 (or attenuating the signal applied to transducer 104 relative to that applied to transducer 106). Similar behavior occurs for a right channel signal, with a null along the null axis 116 arising from the right array 100R.

The two transducers of each of the two arrays have a relatively small spacing 107, 109, for example, in the range of 5 cm to 7 cm on center, while the spacing 111 between the two arrays is wider, for example, in the range of 50 cm to 70 cm. This allows the arrays to be conveniently placed on either side of a typical computer or television monitor. In some examples, the transducers within each array are 6.5 cm apart on center.

At lower frequencies, the two more widely spaced arrays can be used together as if they were a single speaker array. In one lower frequency range, e.g., 550 Hz-1 kHz, one transducer from each array, e.g., outer transducers 104 and 110, are used together as two elements of an array driven so that their acoustic outputs interfere destructively to create a desired radiation pattern, characterized by a null along the null axis 114 between them. The wider element spacing in this frequency range results in increased efficiency of sound radiation by the combined arrays. In another low frequency range, e.g., below 550 Hz, the transducers 104 and 106 from the left array 100L are fed identical signals and are used to form a first acoustic source; the transducers 108 and 110 from the right array 100R are also fed identical signals and are used to form a second source, where the two sources combine to form a single array. The signals sent to the opposite side from which they were intended (i.e., left-side signals fed to the right array 100R) are sometimes referred to in this description as cross-feed signals. The signals sent to the first source and second source are processed as described earlier to create a null along the same null axis 114 described above for higher frequencies. That is, the signal fed to the transducers 104 and 106, in this low frequency range, is identical but of opposite polarity relative to the signal fed to the transducers 108 and 110. One signal may also be delayed with respect to the other, may be filtered with respect to the other, and/or may be attenuated with respect to the other. For example, the signal fed to the transducers 108 and 110 may be delayed relative to the signal fed to the transducers 104 and 106, it may be attenuated by some amount (e.g. 2 dB), and/or it may be filtered (for example, with a low pass filter). A benefit of this arrangement is that the system has more radiating area in this frequency range, (i.e., from all four transducers) which increases the system's maximum output capability. This serves to both achieve the desired radiation pattern and increase the overall output power capability of the system. In general, for arrays with multiple transducers, selectively altering the numbers of transducers that are operating in various frequency ranges can be used to improve system efficiency and maximum output capability, while achieving a desired radiation pattern over a wider range of frequencies.

Another effect of the arrays is that sound images can be placed well to the left of the left array or well to the right of the right array. This can be accomplished by orienting the null axis in a desired direction. The locations of these sound images (the location from which a listener interprets sound as originating) are referred to as the left and right perceptual axes 118 and 120. The orientation of perceptual axes can be controlled by controlling the orientation of null axes. An example of the signal processing used to crate nulls along the null axes is described below, in increasing detail starting from the most basic array building block and adding each functional feature of the signal processing in turn. For the sake of simplicity, this description focuses on the left input signal. As will be seen, the same processing is applied to deliver the right input signal to the appropriate transducers.

Figure 2:
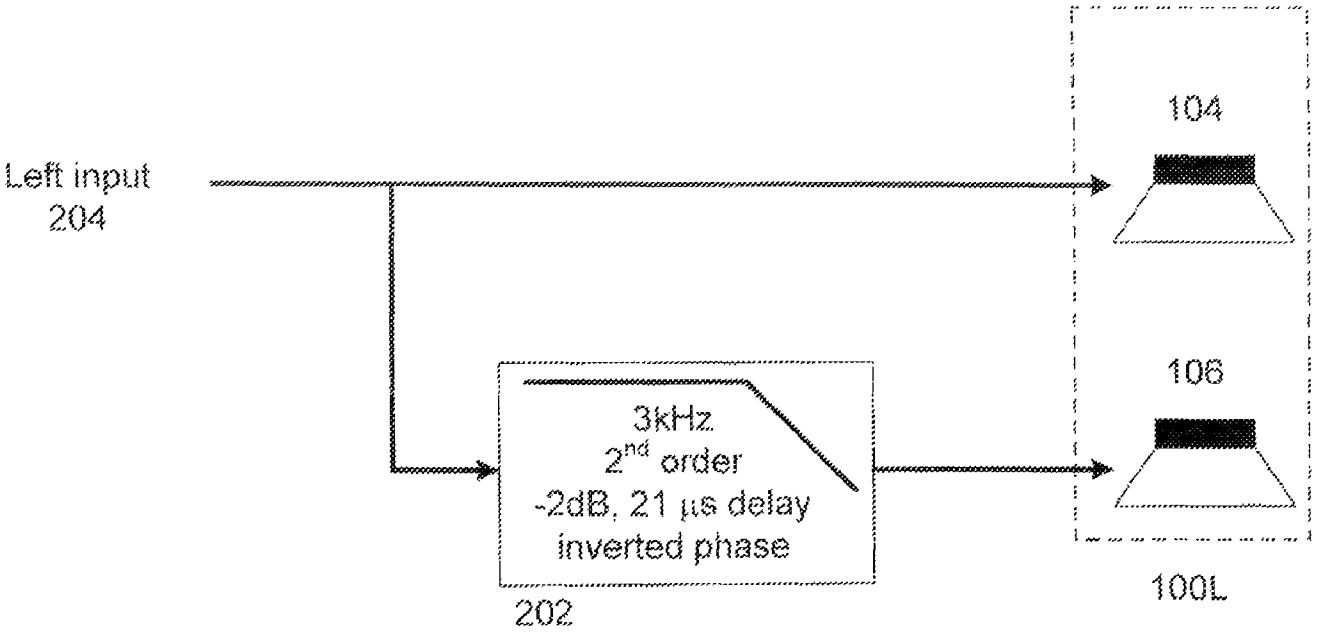
FIGS. 2-5 and 6B-6E are block diagrams of an audio system.

The null along the left null axis 112 is created by splitting the left input signal 204 into two paths and applying a low-pass filter 202 to the signal sent to the left inner transducer 106, as shown in FIG. 2. The full spectrum signal is sent to the left outer transducer 104, which acts as the primary transducer for this signal 204. The low-pass filter 202 prevents signals having frequencies above 3 kHz from reaching the inner transducer 106. The outer transducer 104 can also be angled outward (see FIG. 1) to reduce left-channel high-frequency content from reaching the listener 102 (FIG. 1). The filter 202 also inverts the phase of the signal to create the acoustic null along the null axis 112, with the inner transducer 106 acting as the canceling transducer for this signal 204. In some examples, a 21 μs delay is introduced by the filter 202 to steer the null axis 112 toward the listener 102. Attenuating the filter 202 by 2 dB increases the overall system efficiency without significantly degrading the psychoacoustic effects.

This signal filter 202 used in conjunction with the signal splitting and transducer geometry shown in FIGS. 1 and 2 can render a convincing left perceptual axis which can be displaced from the physical location of the transducers, but, due to the close proximity of the primary and canceling transducers, there are low frequency output limitations. Moving the transducers 104 and 106 farther apart could address this but would require a larger array enclosure and would limit the upper frequency for which the system could control the direction of the null axis 112.

Figure 3:
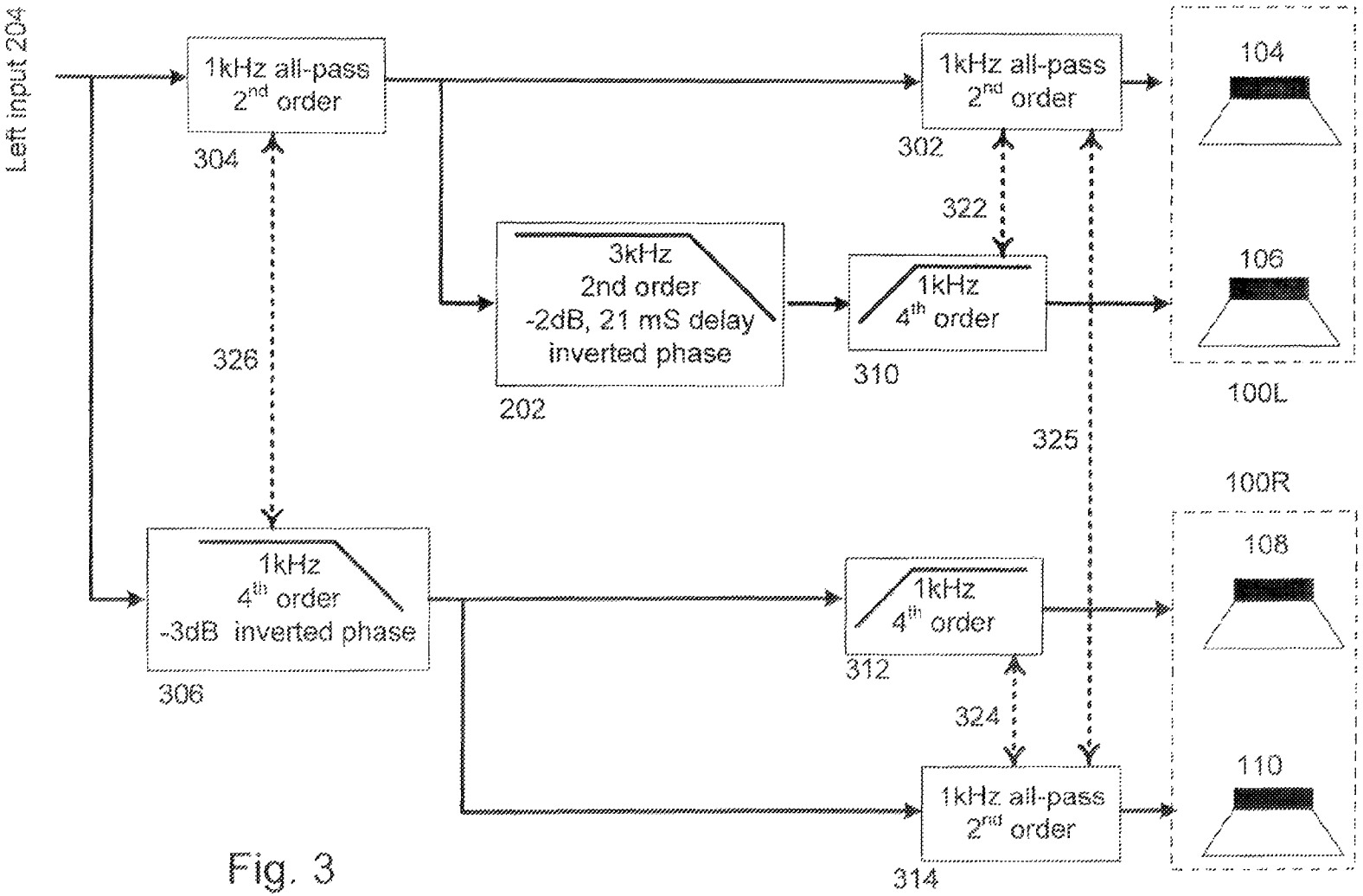

To improve the low frequency efficiency of the array, the right outer transducer can be used as the canceling transducer for low frequencies. In effect, the right array 100R is used as if it were a part of the left array 100L, rather than as a separate loudspeaker intended for right-channel signals. In the example of FIG. 3, this concept is implemented for frequencies below 1 kHz by filtering and inverting the left input 204 with a low-pass filter 306 and applying this signal (i.e., cross-feeding it) to the right array 100R. In some examples, the choice of cross-feed frequency (in this example, 1 kHz) will depend on the capability of the transducers and their spacing as well as subjective decisions about the placement of the perceptual axis. If the null along the null axis 114 is desired to be directly between the speaker arrays, no delay is required in the filter 306. In some examples, the low-frequency null was found to tolerate 3 dB of attenuation on the canceling transducers without perceptual degradation.

With the canceling signal below 1 kHz now cross-fed to array 100R, it is useful to eliminate output from transducers 106 and 108 over this frequency range in a way that does not disrupt the phase relationship already established between the left inner and outer transducers. This can be achieved, for example, by using a pair of high-pass filters 310 and 312 and matching all-pass filters 302 and 314 (dashed arrows 322 and 324 indicate phase matching). The all-pass filters 302 and 314 also phase-matched to each other, as shown by the dashed arrow 325.

Applying the 1 kHz high pass filter 310 to the left inner transducer 106 without the matching all-pass filter would introduce a new phase shift that would disrupt the established null along the null axis 112. To avoid disturbing the null along the null axis 112, the phase of the all-pass filter should match that of the highpass filter over the band of interest (<1 kHz, in this example) within a tolerance of approximately +/−30 degrees. Performance can be improved if the phase match occurs over a larger frequency range, and phase is matched to a tighter degree, such as to approx. +/−15 degrees. Another all-pass filter 304 is applied to the left array input and phase-matched (again within +/−30 degrees) to the right low-pass filter 306 to keep the cross-feed signal in phase with the primary signal. The null formed by the combined outputs of the left transducers 104 and 106 is restricted to the frequency range of 1 kHz to 3 kHz due to the operation of the filters 202 and 310. In other words, for a left input signal 204 within the frequency range of 1 kHz~3 kHz, the left array 100L independently achieves a null along the null axis 112. For a left input signal 204 in the frequency range below 1 kHz, the left outer transducer 104 and the right outer transducer 110 together combine to form a null along the null axis 114. A right signal can be processed in a similar fashion.

Figure 4:
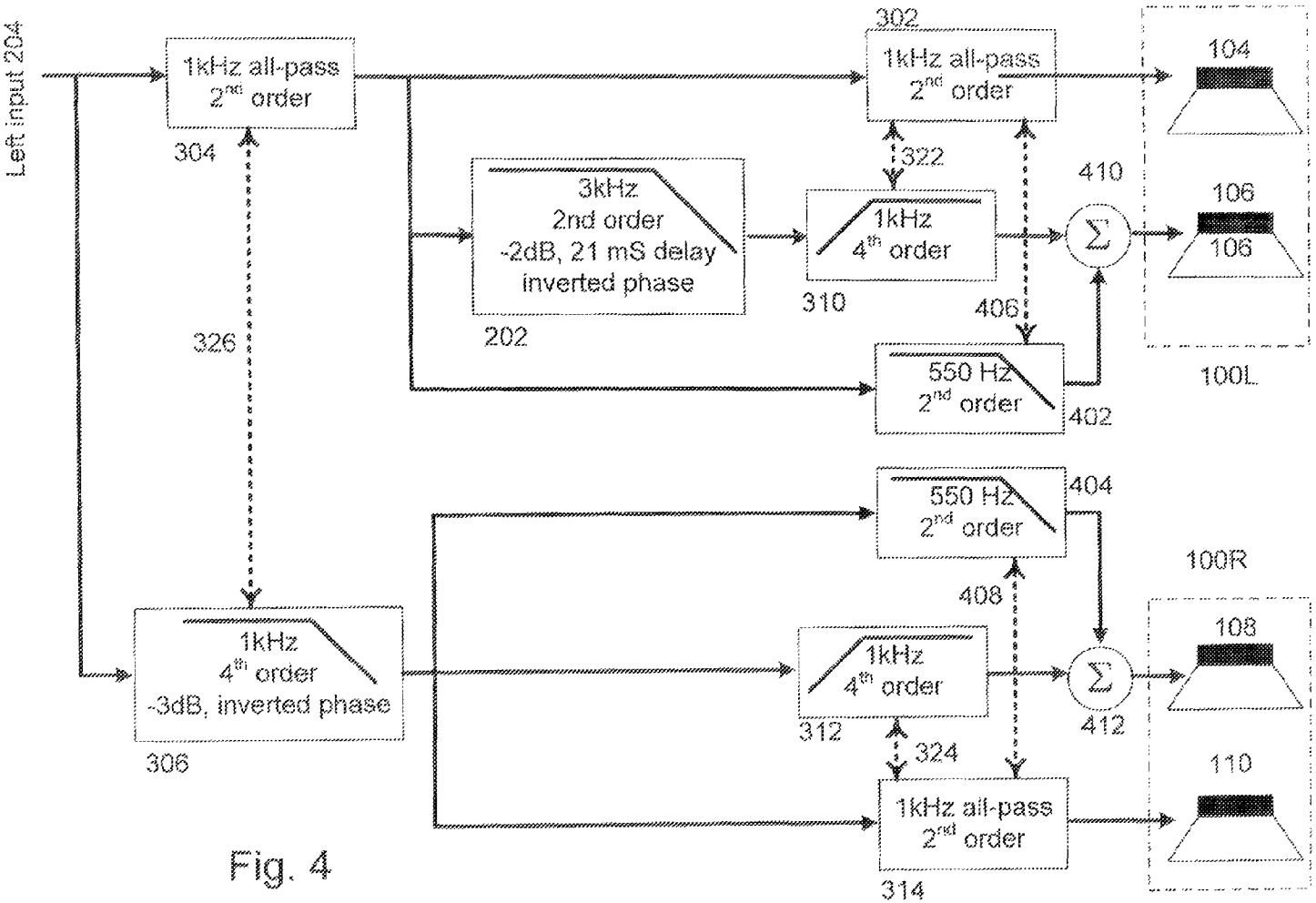

The low frequency performance of this system can be enhanced by using the inner transducers in combination with their corresponding outer transducers in a selected frequency range, for example, a frequency range lower than the frequency range described earlier where only the outer transducers were operating (for example, below 550 Hz). As shown in FIG. 4, a pair of low-pass filters 402 and 404 are added in parallel with the existing filters 310 and 312 to filter the signal input to the left and right inner array transducers 106 and 108, and provide it, mixed with the parallel higher-frequency signals by mixers 410 and 412, to those transducers. Below 550 Hz, filters 402 and 404 are matched in phase (within +/−30 degrees) to filters 302 and 314, shown by dashed arrows 406 and 408. The dashed arrow 325 showing phase-matching between the all-pass filters 302 and 314 is removed for clarity in FIG. 4 and later figures.

Figure 5:
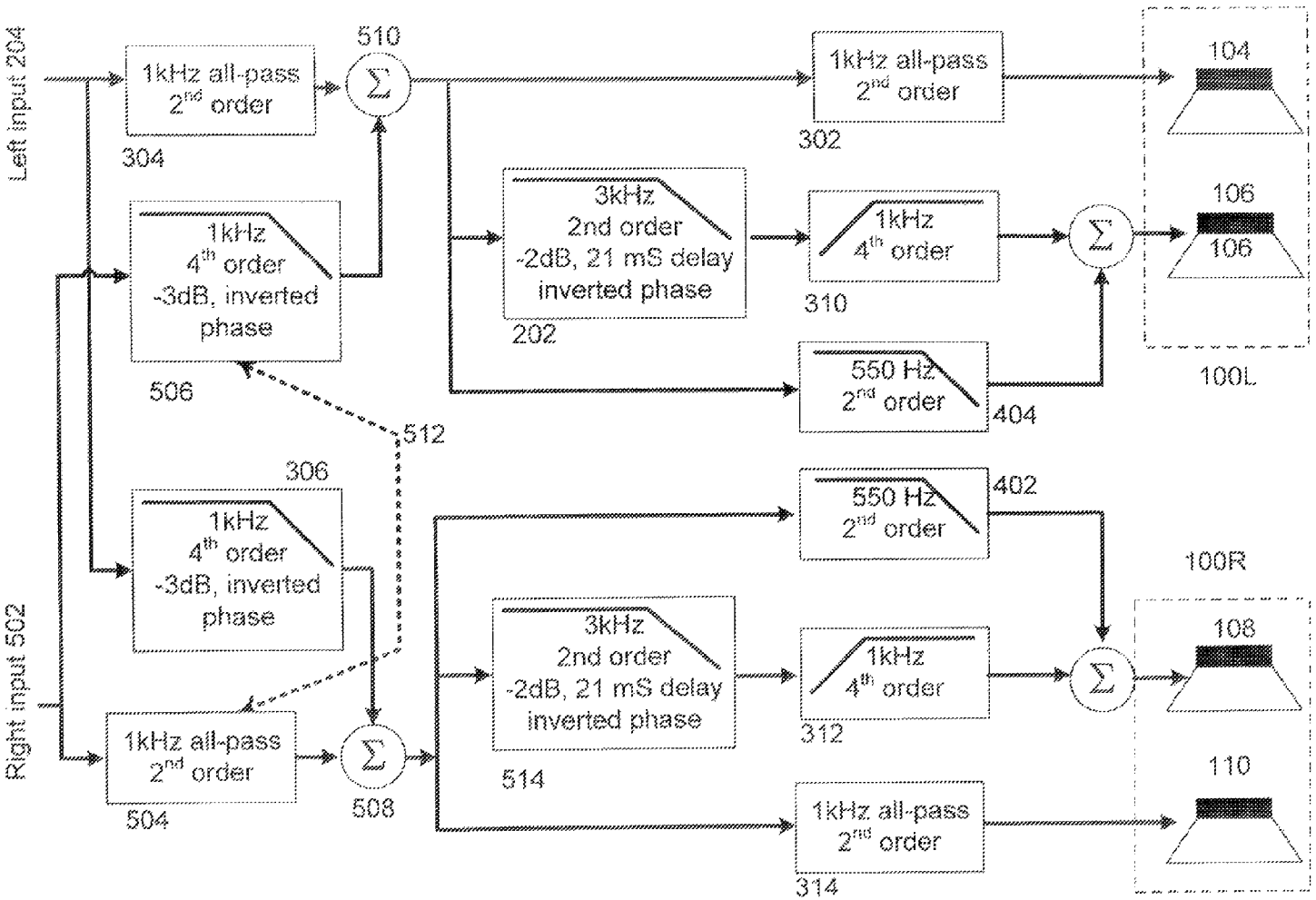

As shown in FIG. 5, most of the filters described so far are the same on the left and right sides, assuming that the left and right arrays are identical, so very little must be added to produce the same effects for the right input 502. If the left and right arrays are not identical, the filter parameters for the left and right signal paths may need to be adjusted to take into consideration the array discrepancies. A low-pass filter 514 (which matches the filter 202) provides an inverted signal to the right inner transducer 108, so that the combined output from the transducers 108 and 110 will produce a null along null axis 116 (FIG. 1) for a moderate frequency range (1 kHz~3 kHz in this example). A low-pass inverting filter 506, which matches the characteristics of the low-pass filter 306, receives the right signal input 502 and provides a right cross-feed signal to the left array 100L so that right-channel low-frequency signals radiated by elements from each array will produce a null along a null axis similar to that achieved for the left channel, in some examples along the same null axis 114 as the left-channel signals. As on the left, an all-pass filter 504 is added to the right input and phase-matched to the right cross-over filter 506, as shown by dashed arrow 512 (the other dashed phase-matching arrows are removed for clarity). Mixers 510 and 508 combine the primary signals with the cross feed signals for both arrays. Each of the filters occurring after the first stage (i.e., after one of filters 304, 306, 504, or 506) produces a signal that is treated as both an output signal based on the input signal for its own side and a cross-feed signal based on the input signal for the opposite side. For example, the signal output from low-pass filter 404 is referred to as both an output signal based on the left input signal 204 and a cross-feed signal based on the right input signal 502, as already filtered by the low-pass cross-feed filter 506. Both signals are fed to the left inner transducer 106.

Figure 6A:
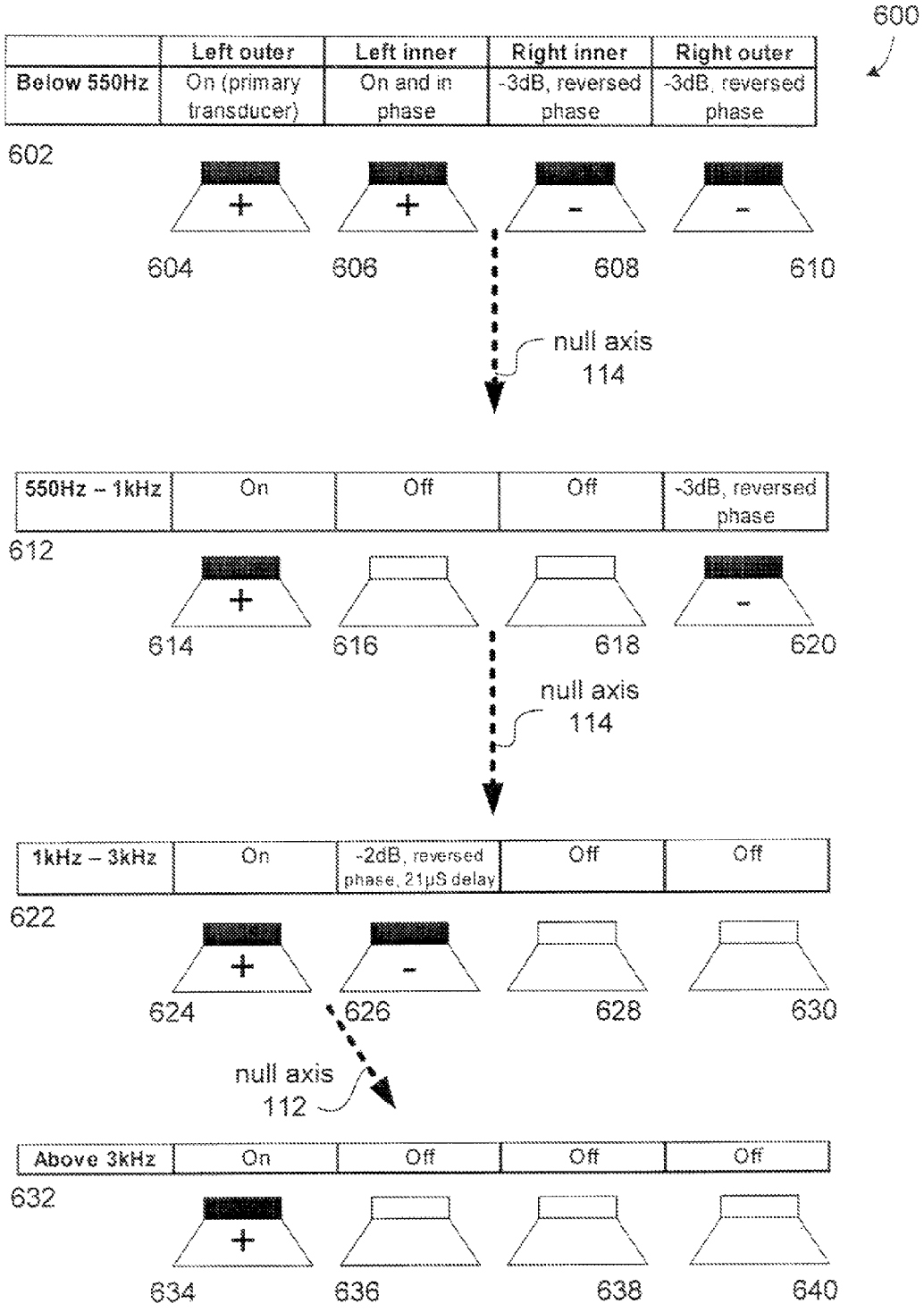
FIG. 6A is a table.

In FIG. 6A, table 600 summarizes the frequency ranges over which each transducer is active in FIG. 4, including attenuation, delay, and phase shift on each transducer. FIGS. 6B-6E shown the active filters and signal paths for each range. Phase relationships are shown relative to the primary transducer(s), where "+" indicates a primary transducer for each range, and "−" indicates a canceling transducer. Transducer symbols with white backs indicate that the transducer is inactive in that frequency range (that is, signals in that range have been substantially attenuated out of the input for that transducer). Table 600 and FIGS. 6B-6E indicate filtering of the left input 204 only. A symmetric table, not shown, would describe the filtering of the right input 502.

Figure 6B:
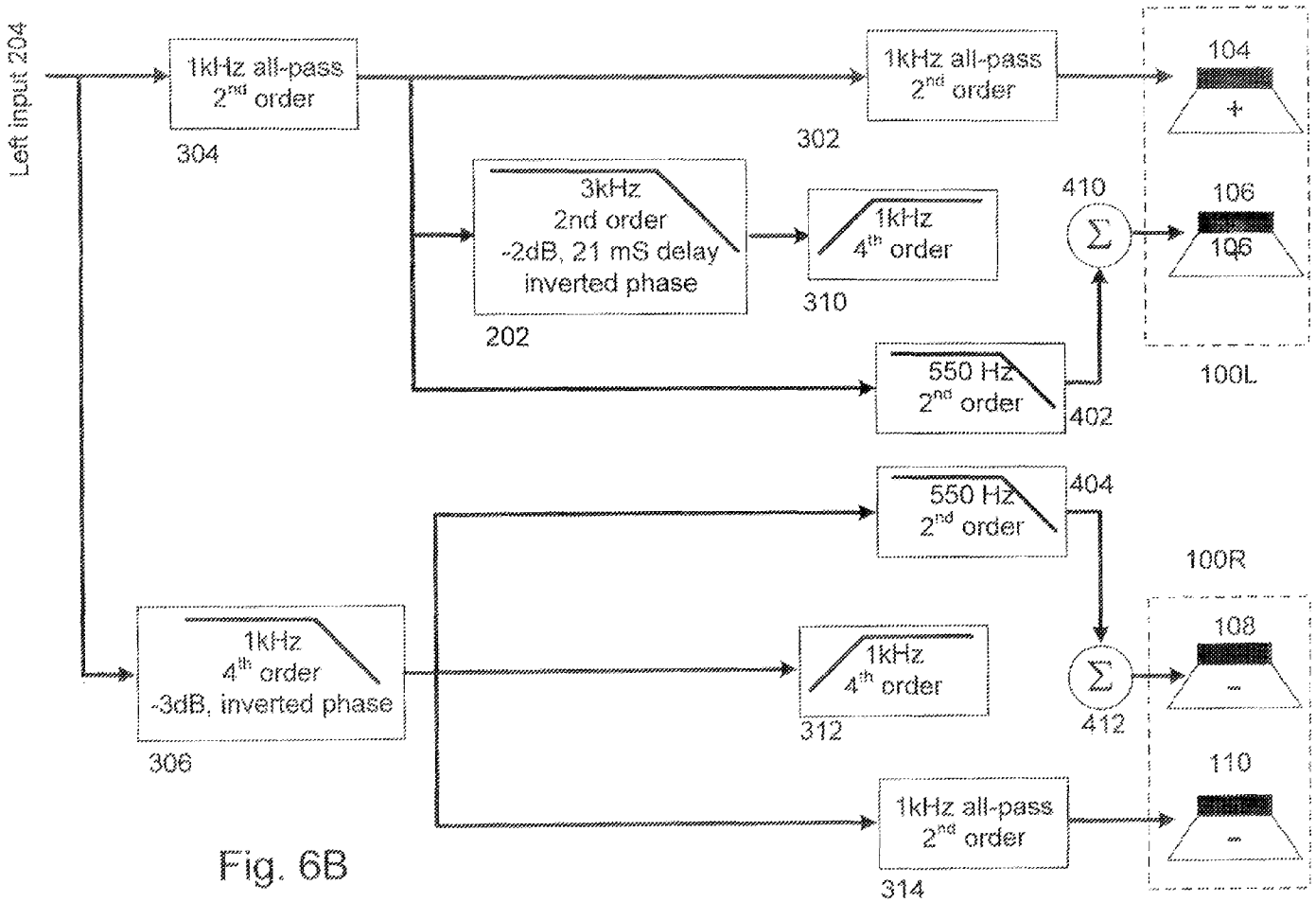

For left channel signal below 550 Hz, as shown by row 602 and FIG. 6B, both left transducers (outer transducer 104 and inner transducer 106) in left array 100L are active and in-phase (symbols 604, 606 in table 100) relative to each other due to the filters 302 for the left outside transducer 104 and 402 for the left inside transducer 106. The two right transducers (outer 110 and inner 108) in right array 100R are active and in phase relative to each other, but, as a whole, they are out of phase with the left transducers, as a whole, as shown by symbols 608, 610. There is also a 3 dB attenuation from the cross-feed low-pass filter 306. The low-pass filter 404 provides the low-frequency signal (already inverted by the filter 306) to the right inner transducer. This combination of outputs of transducers from two arrays provides a desired radiation pattern and is responsible for the null along the null axis 114. The two transducers of each array behave as a single acoustic source, and the source spacing is the spacing between the arrays (as opposed to the spacing between individual array elements) which increases radiation efficiency in this frequency range and also increases the maximum output capability of the system. With this configuration, two arrays behave as a single large array.

Figure 6C:
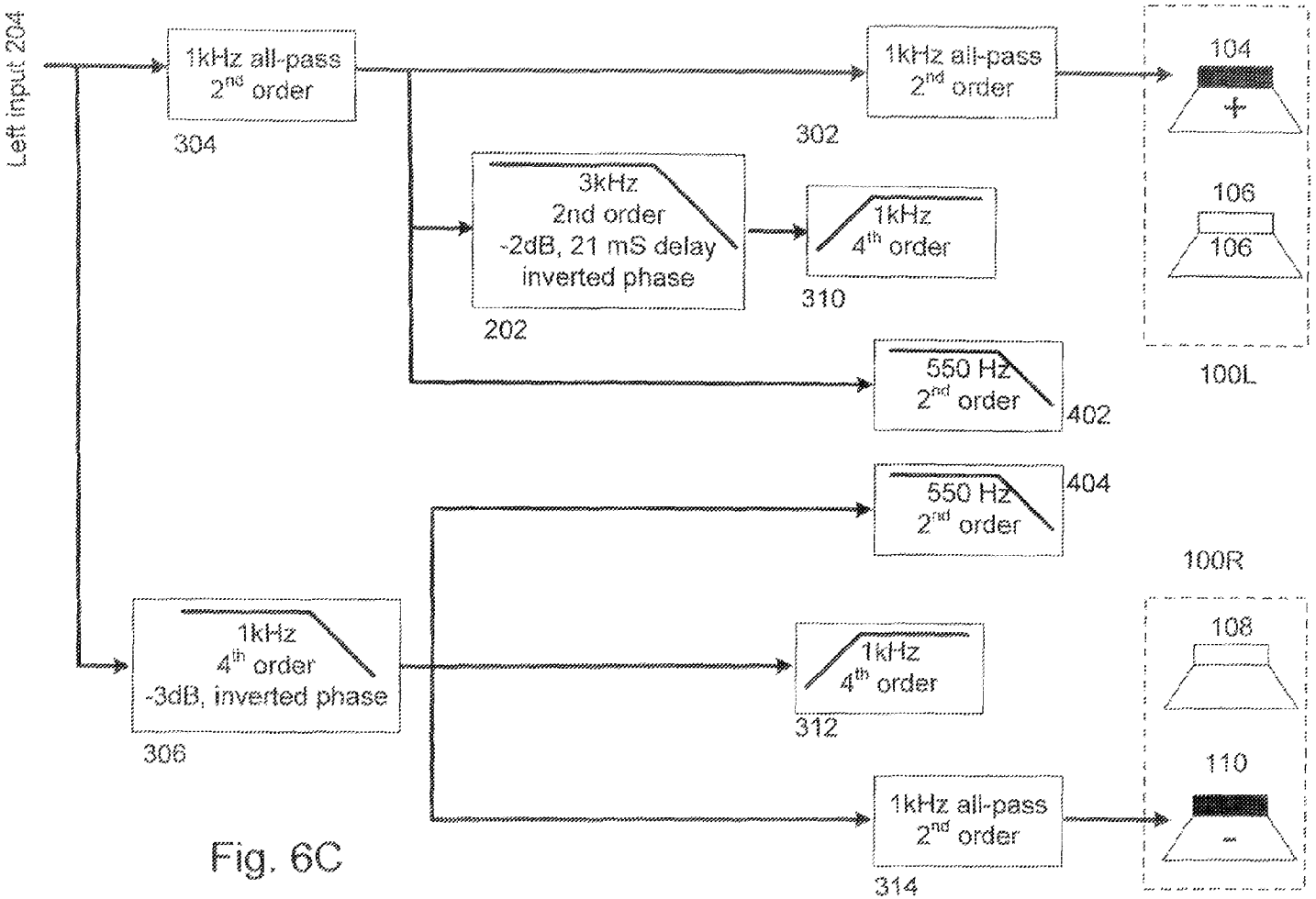

In the range of 550 Hz to 1 kHz of the left channel signal, shown by row 612 and FIG. 6C, the outer transducers 104, 110 are the same as in the lower range (614, 620), while the inner transducers 106, 108 are off (616, 618) due to the combination of the low-pass filters 402 and 404 and the high-pass filters 310 and 312. The outputs from the outer transducers 104 and 110 form a null along a null axis, which may be the null axis 114. In this range, the two arrays 100L, 100R are also behaving as a single large array, increasing low frequency output efficiency. However, only one transducer from each array is operating to avoid interfering with the inverted signals from the high-pass filters 310 and 312 (around 1 kHz in the example). The acoustic null along the null axis 114 could be steered by introducing a delay between the signal applied to the various transducers, if desired.

Figure 6D:
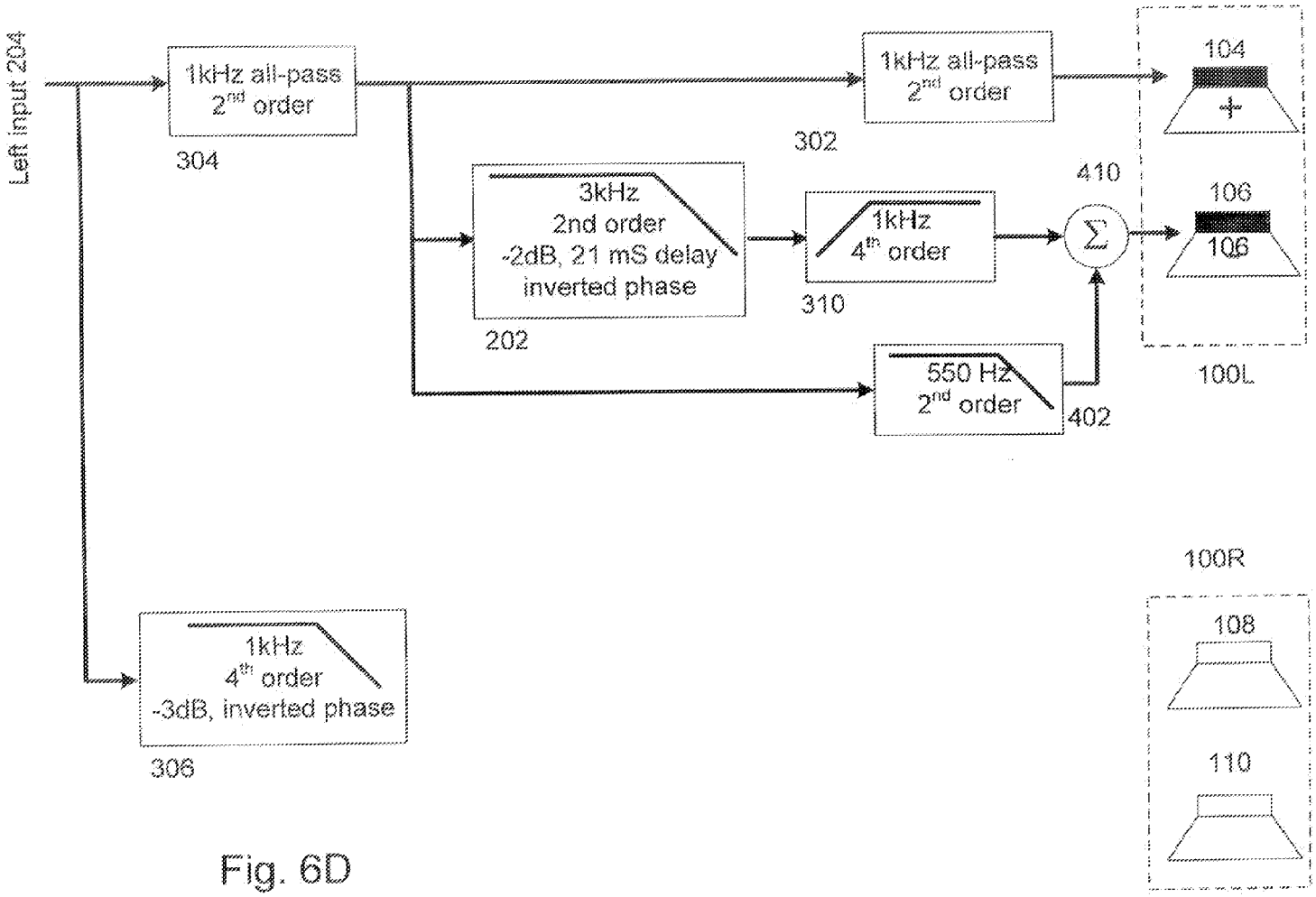

The null along the null axis 112 in the range of 1 to 3 kHz for the left channel signal is produced from the left transducers only, as shown in row 622 and FIG. 6D. The left outer transducer 104 is on as usual (624), while the left inner transducer 106 is attenuated (to increase system maximum output power), phase-reversed (to create the null) (626), and delayed (to steer the null axis 112) by the low-pass filter 202. In this frequency range, both of the right transducers 108, 110 are off (628, 630) due to low-pass filter 306. There is no cross-feed in this frequency range.

Figure 6E:
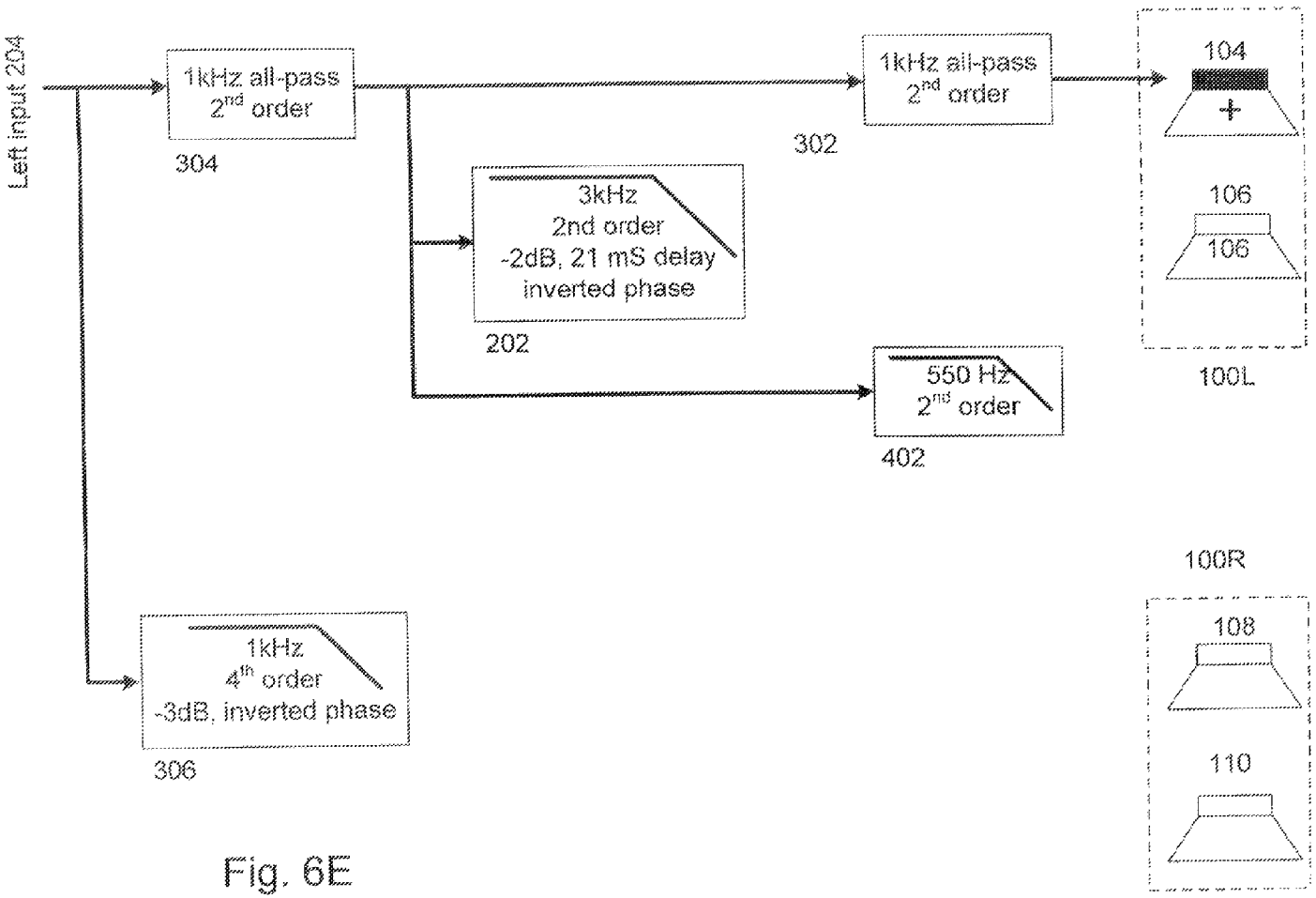
Figure 7A:
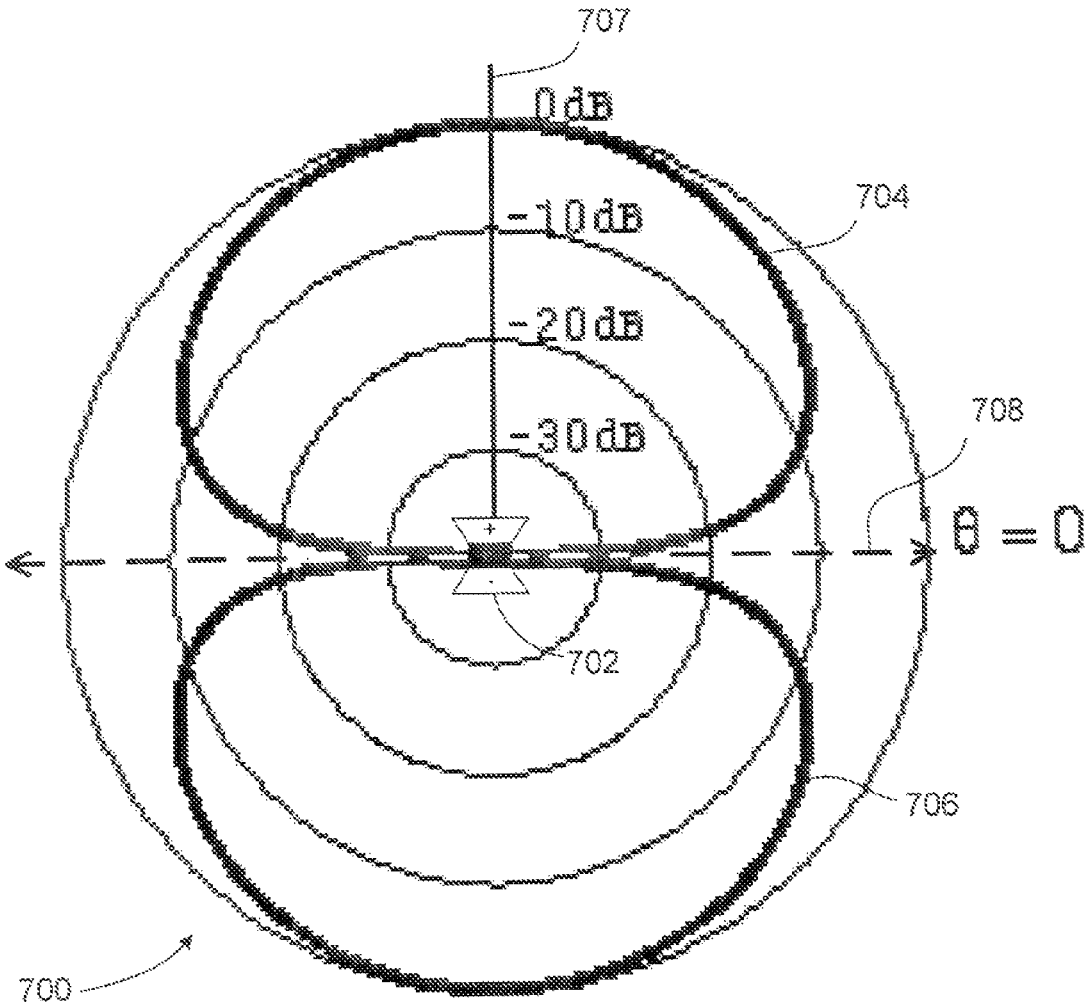
FIG. 7A-7C are graphs.
Figure 7B:
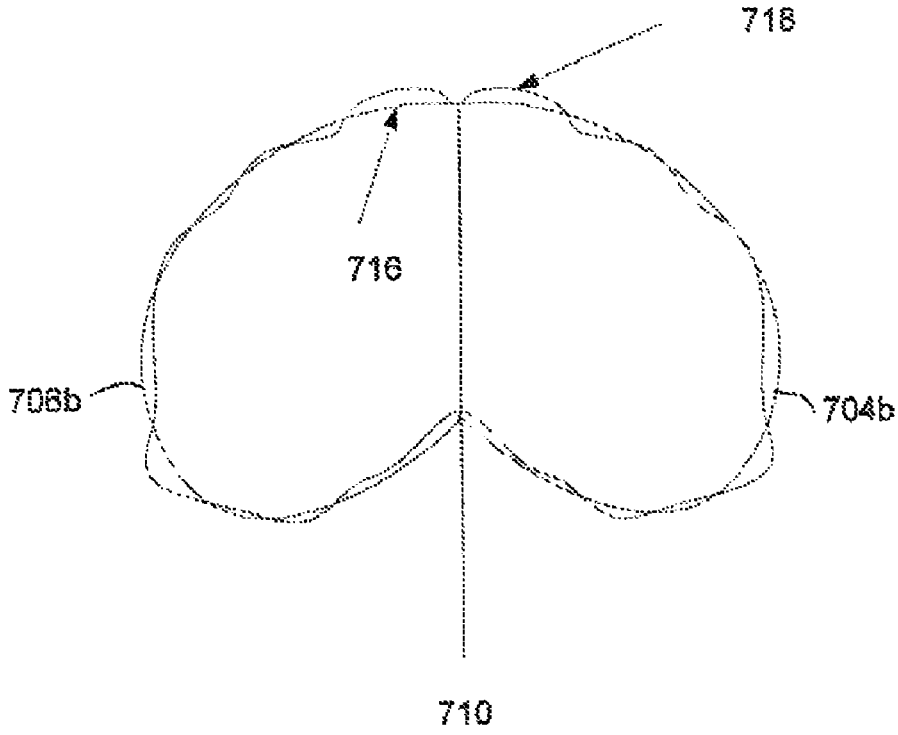
Figure 7C:
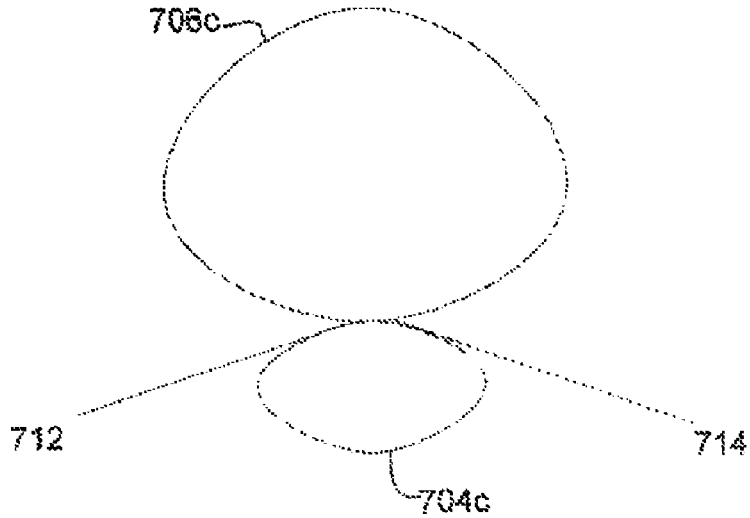

Above 3 kHz, as shown in row 632 and FIG. 6E, the right transducers 108, 110 remain off (638, 640), and the left inner transducer 106 is also turned off (636) by filter 202. Only the left outer transducer 104 remains on (634).

In general, by using the respective elements of each individual array to independently control that array's radiation pattern at higher frequencies, and using both arrays jointly in some manner to control the radiation pattern of the combined array output at lower frequencies, efficiency can be maintained or improved at low frequencies and directivity controlled over a wider frequency range. Since the widely-spaced arrays improve total system efficiency, the system can deliver more power at low frequencies, compared to a system that only used each array to control its own side's signal.

As noted above, similar techniques can be used to deploy arrays having any number of transducers. The details of frequencies to filter, which signal to invert, shift, or delay, and where to position the transducers will depend on such factors as the number of transducers, characteristics of the transducers, the output desired, the environment where the arrays are to be used, and the power output capability of each transducer.

Other embodiments are within the scope of the following claims.

What is claimed is:

1. An apparatus comprising:

first and second arrays of transducers; and filters to operate on a first input signal to provide output signals and cross-feed signals to the transducers of the first and second arrays so that (a) a combination of a plurality of transducers of the first array produces destructive interference in a first frequency range;

(b) the combination of the plurality of transducers of the first array does not produce destructive interference in a second frequency range; and (c) a combination of a first transducer of the first array and a first transducer of the second array produces destructive interference in the second frequency range and does not produce destructive interference in the first frequency range.

2. The apparatus of claim 1 in which the first frequency range comprises a range of frequencies for which the corresponding wavelengths are greater than twice a spacing between the transducers in the first array.

3. The apparatus of claim 2 in which the range of frequencies is also one for which the corresponding wavelengths are less than twice a spacing between the first and second array.

4. The apparatus of claim 1 in which the second frequency range comprises a range of frequencies for which the corresponding wavelengths are greater than twice a spacing between the first and second array.

5. The apparatus of claim 1 in which the first frequency range comprises frequencies between about 1 kHz and about 3 kHz.

6. The apparatus of claim 1 in which the second frequency range comprises frequencies below about 1 kHz.

7. The apparatus of claim 1 in which in which the first frequency range comprises frequencies between an upper frequency and a lower frequency and the filters comprise:

in series, an inverting low-pass filter having a corner frequency at the upper frequency and a high-pass filter having a corner frequency at the lower frequency, providing output signals to the first transducer of the first array; and an all-pass filter phase-matched to the high-pass filter and providing output signals to the second transducer of the first array.

8. The apparatus of claim 1 in which the filters are configured to delay the output signal to the first transducer of the first array relative to the output signal to the second transducer of the first array.

9. The apparatus of claim 1 in which the filters attenuate the cross-feed signals to the transducers of the second array when the input signal is in the first frequency range.

10. The apparatus of claim 9 in which the first frequency range comprises frequencies between an upper frequency and a lower frequency and the filters comprise:

a low-pass filter having a corner frequency at the lower frequency and providing cross-feed signals to the second array; and an all-pass filter phase-matched to the low-pass filter and providing output signals to the first array.

11. The apparatus of claim 1 in which the second frequency range comprises frequencies below a first upper frequency and the filters comprise:

an inverting low-pass filter having a corner frequency at the upper frequency and providing cross-feed signals to the second array; and an all-pass filter phase-matched to the inverting low-pass filter and providing output signals to the first array.

12. The apparatus of claim 1 in which the filters attenuate the output signals to a second transducer of the first array when the input signal is in the second frequency range.

13. The apparatus of claim 12 in which the second frequency range comprises frequencies below a first upper frequency and the filters comprise:

a first high-pass filter having a corner frequency at the first upper frequency and providing output signals to the second transducer of the first array;

a first all-pass filter phase-matched to the high-pass filter and providing output signals to the first transducer of the first array; and a second all-pass filter phase-matched to the first all-pass filter and providing cross-feed signals to the first transducer of the second array.

14. The apparatus of claim 13 in which the filters also comprise:

a second high-pass filter having a corner frequency at the first upper frequency, providing cross-feed signals to a second transducer of the second array, and phase matched to the second all-pass filter.

15. The apparatus of claim 12 in which the first frequency range is bounded by a first upper frequency and a first lower frequency;

the second frequency range is bounded by a second upper frequency and a second lower frequency; and in which the filters provide output signals and cross-feed signals to the second transducer of the first and second array in a third frequency range bounded by a third upper frequency and a third lower frequency, wherein the third upper frequency is lower than the first upper frequency.

16. The apparatus of claim 15 in which the filters comprise:

first and second low-pass filters having corner frequencies at the second upper frequency and providing output signals and cross-feed signals to the second transducer of each of the first and second arrays, respectively; and first and second all-pass filters phase matched to the first and second low-pass filters, respectively, and to each other, and providing output signals and cross-feed signals to the first transducer of each of the first and second arrays, respectively.

17. The apparatus of claim 1 in which the filters also provide the output signals and cross-feed signals to the transducers of the first and second arrays so that (d) no destructive interference is produced in a third frequency range.

18. The apparatus of claim 17 in which the third frequency range comprises a range of frequencies for which the corresponding wavelengths are less than twice a spacing between the transducers in the first array.

19. The apparatus of claim 17 in which the third frequency range comprises frequencies above about 3 kHz.

20. The apparatus of claim 17 in which the third frequency range comprises frequencies above a lower frequency, and the filters are configured to cause the first transducer of the first array to be to be active, and to attenuate the output signals to a second transducer of the first array when an input signal is above the lower frequency.

21. The apparatus of claim 20 in which the filters comprise a low-pass filter having a corner frequency at the lower frequency and providing output signals to the second transducer of the first array.

22. The apparatus of claim 20 in which the filters are also configured to attenuate the cross-feed signals to the transducers of the second array when the input signal is in the third frequency range.

23. The apparatus of claim 22 in which the filters comprise:

a first low-pass filter having a corner frequency at the lower frequency and providing output signals to the second transducer of the first array;

a second low-pass filter having a corner frequency at or lower than the lower frequency and providing cross-feed signals to the second array; and an all-pass filter phase-matched to the second low-pass filter and providing output signals to the first array.

24. The apparatus of claim 17 in which the filters comprise a first all-pass filter providing output signals to a first summing input of the first array, a second all-pass filter providing output signals to an input to the first transducer of the first array, a first low-pass filter and a first high-pass filter in series and providing output signals to a first summing input to the second transducer of the first array, a second low-pass filter providing output signals to a second summing input to the second transducer of the first array, a third low-pass filter providing cross-feed signals to a first summing input of the second array, a third all-pass filter providing cross-feed signals to an input to the first transducer of the second array, a fourth low-pass filter and a second high-pass filter in series and providing cross-feed signals to a first summing input to the second transducer of the second array, and a fifth low-pass filter providing cross-feed signals to a second summing input to the second transducer of the second array.

25. The apparatus of claim 24 in which the second and fifth low-pass filter have corner frequencies at a lower frequency;

the third low-pass filter and the first and second high-pass filters have corner frequencies at an intermediate frequency; and the first and fourth low-pass filters have corner frequencies at an upper frequency.

26. The apparatus of claim 24 in which the filters also comprise a sixth low-pass filter providing a cross-feed signal to a second summing input of the first array;

a fourth all-pass filter providing an output signal to a second summing input of the second array;

and in which a first signal input is coupled to the first all-pass filter and the third low-pass filter, and a second input signal is coupled to the fourth all-pass filter and the sixth low-pass filter.

27. The apparatus of claim 26 in which the first input signal is a left-channel input and the second input signal is a right-channel input.

28. The apparatus of claim 1 in which the filters also provide the output signals and cross-feed signals to the transducers of the first and second arrays so that (d) the combination of the plurality of the transducers of the first array does not produce destructive interference in a an additional frequency range; and (e) a combination of the plurality of transducers of the first array and of the plurality of transducers of the second array produces destructive interference in the additional frequency range.

29. The apparatus of claim 28 in which the additional frequency range comprises frequencies below about 550 Hz.

30. The apparatus of claim 1 in which the filters also operate on a second input signal to provide output signals and cross-feed signals to the transducers of the second and first arrays so that (d) a combination of a plurality of transducers of the second array produces destructive interference in the first frequency range;

(e) the combination of the plurality of the transducers of the second array does not produce destructive interference in the second frequency range; and (c) a combination of the first transducer of the first array and the first transducer of the second array produces destructive interference based on both the first input signal and the second input signal in the second frequency range.

31. The apparatus of claim 30 in which the first input signal is a left-side signal and the second input signal is a right-side signal.

32. A method comprising filtering input signals and distributing the filtered signals as output signals and cross-feed signals to first and second physically separate arrays of transducers to drive transducers of the first and second arrays so that (a) a combination of the plurality of transducers of the first array produces destructive interference in a first frequency range;

(b) the combination of the plurality of transducers of the first array does not produce destructive interference in a second frequency range; and (c) a combination of a first transducer of the first array and a first transducer of the second array produces destructive interference in the second frequency range and does not produce destructive interference in the first frequency range.

33. The method of claim 32 in which the first frequency range comprises a range of frequencies for which the corresponding wavelengths are greater than twice a spacing between the transducers in the first array.

34. The method of claim 33 in which the range of frequencies is also one for which the corresponding wavelengths are less than twice a spacing between the first and second array.

35. The method of claim 32 in which the second frequency range comprises a range of frequencies for which the corresponding wavelengths are greater than twice a spacing between the first and second array.

36. The method of claim 32 in which the first frequency range comprises frequencies between about 1 kHz and about 3 kHz.

37. The method of claim 32 in which the second frequency range comprises frequencies below about 1 kHz.

38. The method of claim 32 in which the output signals and cross-feed signals also drive transducers of the first and second array so that (d) no destructive interference is produced in a third frequency range.

39. The method of claim 38 in which the third frequency range comprises a range of frequencies for which the corresponding wavelengths are less than twice a spacing between the transducers in the first array.

40. The method of claim 38 in which the third frequency range comprises frequencies above about 3 kHz.

41. The method of claim 32 in which the output signals and cross-feed signals also drive transducers of the first and second array so that (d) the combination of the plurality of the transducers of the first array does not produce destructive interference in a an additional frequency range; and (e) the combination of the plurality of transducers of the first array and of the plurality of the transducers of the second array produces destructive interference in the additional frequency range.

42. The method of claim 41 in which the additional frequency range comprises frequencies below about 550 Hz.

43. An apparatus comprising:

first and second arrays of transducers; and filters to operate on an input signal to provide output signals and cross-feed signals to drive transducers of the first and second arrays so that (a) a combination of a plurality of transducers of the first array produces substantially different degrees of destructive interference in respectively first and second frequency ranges; and (b) a combination of a transducer of the first array and a transducer of the second array produces destructive interference in the second frequency range and does not produce destructive interference in the first frequency range;

in which first signals driving the first array and second signals driving the second array are not identical.

44. An apparatus comprising:

filters to operate on an input signal to provide output signals and cross-feed signals to drive transducers of first and second arrays so that (a) a combination of a plurality of transducers of the first array produces destructive interference in a first frequency range;

(b) the combination of the plurality of the transducers of the first array does not produce destructive interference in a second frequency range; and (c) a combination of a transducer of the first array and a transducer of the second array produces destructive interference in the second frequency range and does not produce destructive interference in the first frequency range.

* * * * *